United States Patent [19]

Curtin

[11] Patent Number: 4,545,620

[45] Date of Patent: Oct. 8, 1985

[54] PROCESS FOR THE RECOVERY OF A MINERAL

[75] Inventor: Daniel J. Curtin, Plano, Tex.

[73] Assignee: Atlantic Richfield Company, Los Angeles, Calif.

[21] Appl. No.: 969,920

[22] Filed: Dec. 15, 1978

[51] Int. Cl.[4] ..... E21B 43/28

[52] U.S. Cl. ..... 299/4; 166/263

[58] Field of Search ..... 166/263, 268; 299/4, 299/5

[56] References Cited

U.S. PATENT DOCUMENTS

| | | | |
|---|---|---|---|
| 3,442,331 | 5/1969 | Fulton et al. | 166/263 |
| 3,498,378 | 3/1970 | Stone et al. | 166/263 |
| 3,713,698 | 1/1973 | Rhoades | 299/4 |
| 3,734,183 | 5/1973 | Rhudy et al. | 166/263 |

*Primary Examiner*—George A. Suchfield

*Attorney, Agent, or Firm*—F. Lindsey Scott; Ronnie D. Wilson

[57] ABSTRACT

The present invention relates to an improved process for the solution mining of a mineral from a subterranean formation. More specifically, the invention relates to an improved process which enhances significantly the recovery of a mineral from a subterranean formation via solution mining. The improvement comprises periodically ceasing injection of leach solution while continuing production to alter the path of flow of the leach solution between an injection well and a production well and subsequently injecting leach solution.

9 Claims, No Drawings

PROCESS FOR THE RECOVERY OF A MINERAL

Generally, known methods for solution mining of a mineral in situ utilize an acid or alkaline leach solution for the dissolution of the mineral. An oxidant is injected into the formation along with the leach solution. The mineral is leached from the formation and recovered from a production well via a pregnant leach solution. Various procedures for recovering the mineral from the pregnant leach solution are well known, such as ion exchange.

The process of the present invention is particularly suitable for the leaching of uranium; however, my invention is not so limited. The following description of the present invention will be in regard to uranium leaching; however, it is apparent that it is applicable to leaching other mineral values such as copper, nickel, molybdenum, rhenium and selenium where similar problems are encountered.

Although acid leaching solutions can be used in some uranium-containing formations, only alkaline leaching solutions can be used where the particular formation contains significant quantities of acid-consuming gangue.

It is well-known that to increase the recovery of uranium from an underground ore body, it is necessary to convert the relatively insoluble tetravalent state of uranium in the ore to the solubilizable hexavalent state. When using an alkaline leach solution, the dissolution of the uranium in solution occurs in two steps. The first step involves the oxidation of uranium and the second the dissolution of the oxidized uranium in the solution.

It has been found that during the early stages (when the ore body is in a reduced state) of a leach operation utilizing alkaline solutions of ammonium carbonate, sodium carbonate and potassium carbonate and their respective bicarbonates in conjunction with the typical oxidants of air, oxygen, and hydrogen peroxide, the uranium that is oxidized and dissolved near the injection well is reduced and precipitated in the more reduced regions of the formation between the injection well and the production well. Through this action the oxidized region of the formation becomes enriched as the leach operation continues. Therefore, this process of oxidation and dissolution followed by reduction and precipitation continues as the formation becomes progressively oxidized, whereby the region in the immediate vicinity of the production well becomes progressively enriched. The uranium is depleted from a zone in the formation far more quickly than the oxidant-consuming gangue species present therein. Therefore, as the uranium oxidation front recedes from the injection well, the available oxidant for oxidation of the uranium decreases. This causes a slower dissolution of uranium and a lower maximum concentration of uranium in solution as the depleted zone moves through the formation.

It has further been found that during an in situ uranium mining operation that portions of the uranium-bearing formation are not contacted by fresh leach solution. This occurs because the contact between the uranium-bearing deposit and leach solution is limited by diffusion. Since flow in a subterranean formation occurs predominantly along lines of least resistance between an injection and a production well, representing only a small portion of the formation, much of the formation can be contacted by leach solution only after prohibitively slow diffusion processes across relatively large distances between fresh leach solution and unleached uranium-bearing deposits. Therefore, there is needed a process whereby a formation containing a mineral such as uranium can be leached with a solution which rapidly reaches the uranium-bearing deposit and enhances the recovery of the mineral therefrom.

Therefore, it is an object of the present invention to provide an improved process for the solution mining of a mineral from a subterranean formation, applicable generally to minerals requiring oxidation to be leached and to both acid and alkaline leach solutions.

A further object of the present invention is to provide an improved process for the solution mining of uranium.

It is an additional objective of the present invention to provide an improved process for the solution mining of uranium from subterranean deposits which rapidly reaches a large portion of the deposit with freshly injected leach solution to enhance the mineral recovery therefrom.

Other objects, aspects and the several advantages of the present invention will become apparent upon a further reading of this disclosure and the appended claims.

It has now been found that the objects of the present invention can be attained in a process for the solution mining of a mineral from a subterranean formation containing same in which an injection and production well are drilled and completed within said formation, a leach solution and an oxidant are injected through the injection well into the formation to dissolve the mineral and recover it via a production well, by periodically ceasing the injection of leach solution while continuing production to alter the path of flow of the solution through the formation between the injection and production wells and subsequently injecting the leach solution.

In the operation of the improved process to recover uranium, the cessation of the injection of the leach solution while continuing production will alter the flow path of the injected solution. By the improved process, the flow of the leach solution, which is predominantly horizontal in a limited number of narrow channels of low resistance between the injection and production wells, has imposed on it a vertical component which effects the formation solution across the entire formation and from its top to its bottom. The vertical movement of formation solution greatly enhances the contact of the freshly injected leach solution with the previously uncontacted uranium-bearing deposit. Therefore, the uranium will be produced at a higher concentration than would be attainable if no cessation occurred.

It is important that the cessation of the injection of leach solution take place periodically to provide fresh leach solution contact with the uranium-bearing rock by altered flow paths to most efficiently utilize the present invention. Without cessation of leach solution injection periodically, portions of the uranium-bearing formation might never be contacted. The small pores and pockets of aqueous solution throughout the formation would prevent contact of the uranium present therein with fresh leach solution and never be recovered.

The determination of when to periodically cease injection of leach solution and draw down the formation solution level to expose substantial portions of the formation to fresh leach solution is a function of well spacing and of the size of the formation. Preferably, the cessation should be made when uranium concentration in the recovered pregnant solution begins to decline noticeably. For example, a decline of about 10% to 25% in the uranium concentration in the recovered pregnant solution would trigger a cessation in the injection of leach solution. The determination of size and permeability characteristics of the formation can be made by using conventional means.

The determination of how long one ceases to inject leach solution is a function of the size and permeability characteristics of the specific formation one is leaching and thus the draw down level necessary to alter the solution flow paths. Depending on the formation, one might cease injection until the solution level has been lowered 1 inch or 10 feet, whatever is necessary to alter the flow paths of the solution.

Cycling of fresh leach solution through a formation by the present invention will provide for contact of a large portion of the uranium-bearing materials in the formation and faster recovery of the uranium and no longer have uranium recovery limited by diffusion through stagnant water. By the present invention, pregnant leach solution will be displaced from a large portion of the formation. Small pockets or pores may be drained of water and replaced by fresh leach solution which has not had the oxygen depleted therefrom by gangue reactions prior to contacting uranium-bearing materials.

The improved contacting and recovery of the present invention is surprising because one would expect that the ceasing of injection of solution while continuing to produce would only exert a significant change in the formation solution level in the close vicinity of the production well. However, the level of the formation solution away from the production well will be lowered, even if only to a small degree, and the flow path of the solution will be altered. By lowering the level of the formation solution, exposure of small pockets or pores in the formation to fresh leach solution is achievable.

Therefore, through the utilization of the present invention, the recovery of uranium via in situ leaching processes, can be enhanced significantly by most effectively using fresh leach solution to oxidize and dissolve uranium rather than gangue.

Having thus described the invention, I claim:

1. An improved process for the solution mining of a mineral from a subterranean formation containing same in which an injection and production well are drilled and completed within said formation. leach solution and an oxidant are injected through said injection well into said formation to dissolve said mineral, and said dissolved mineral is recovered via said production well, wherein the improvement comprises periodically ceasing the injection of said leach solution subsequent to a decline in the concentration of said mineral in said solution recovered via said production well while continuing production to alter the flow path of said leach solution in said formation between said injection and production wells and subsequently injecting said leach solution.

2. The improvement of claim 1 wherein said periodic cessation occurs subsequent to a decline of at least 10% in the concentration of said mineral.

3. The improvement of claim 1 wherein said injecting of leach solution subsequent to periodic cessation occurs when the solution level of said formation has been lowered.

4. The improvement of claim 1 wherein said mineral is selected from the group consisting of copper, nickel, molybdenum, rhenium, selenium and uranium.

5. The improvement of claim 1 wherein said leach solution is acidic in nature.

6. The improvement of claim 5 wherein said acid leach solution is selected from the group consisting of hydrochloric and sulfuric acid.

7. The improvement of claim 1 wherein said leach solution is alkaline in nature.

8. The improvement of claim 7 wherein said alkaline leach solution is an aqueous solution of one or more salts selected from the group consisting of ammonium carbonate, sodium carbonate, pottasium carbonate and their respective bicarbonates.

9. The improvement of claim 1 wherein said oxidant is selected from the group consisting of air, oxygen and hydrogen peroxide.

* * * * *